US005351856A

United States Patent [19]

Laidlaw

[11] Patent Number: 5,351,856

[45] Date of Patent: Oct. 4, 1994

[54] VENDING MACHINE FOR INDIVIDUAL CIGARETTES

[76] Inventor: Ronald W. Laidlaw, 8790 E. Lupine Dr., Scottsdale, Ariz. 85260

[21] Appl. No.: 967,788

[22] Filed: Oct. 28, 1992

[51] Int. Cl.[5] ..... G07F 11/44; A24F 15/04

[52] U.S. Cl. ..... 221/131; 221/203; 221/266; 221/281; 194/350

[58] Field of Search ..... 194/255, 350; 221/203, 221/266, 281, 131

[56] References Cited

U.S. PATENT DOCUMENTS

| | | | |
|---|---|---|---|
| 471,053 | 3/1892 | Henry | 221/266 X |
| 1,795,117 | 3/1931 | Green | 194/255 |
| 2,923,437 | 2/1960 | Miller | 221/266 |
| 3,960,299 | 6/1976 | Hollinger | 221/266 X |
| 4,679,684 | 7/1987 | Glaser | 194/350 |

FOREIGN PATENT DOCUMENTS

| | | | |
|---|---|---|---|
| 1-171086 | 7/1989 | Japan | 221/281 |
| 1529387 | 10/1978 | United Kingdom | 221/203 |

*Primary Examiner*—F. J. Bartuska
*Attorney, Agent, or Firm*—Donald J. Lisa

[57] ABSTRACT

A vending machine (10) includes three individual vendors (28), each of which dispenses cigarettes (20) one at a time. Cigarettes (20) are loaded into a holding bin (50) via a loading box (30) having a removable, horizontal floor (62). The cigarettes (20) reside in the holding bin (50) in a horizontal orientation. The holding bin (50) feeds the cigarettes to a slot (102) in a cylindrical, horizontally disposed dispensing member (52). The dispensing member (52) rotates in a single direction under the control of a coin mechanism (22). As the coin mechanism rotates, an agitator (124) cooperates with dimensioning in the holding bin (50) to prevent arches or bridges from forming and to insure that a cigarette (20) is fed into the slot (102). Continued rotation of the dispensing member (52) causes the cigarette (20) contained within the slot (102) to pass out of the holding bin (50) and fall into a dispensing tray (54).

27 Claims, 3 Drawing Sheets

Fig. 1
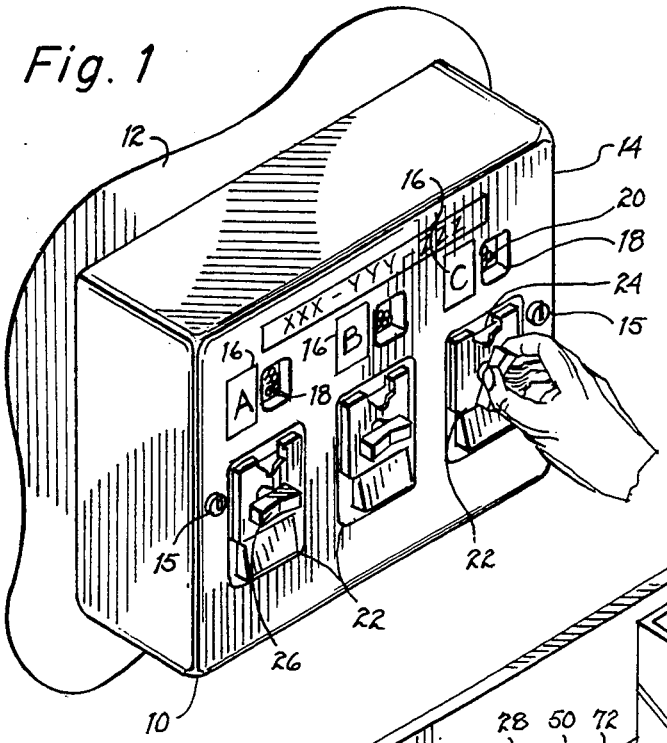
Fig.8
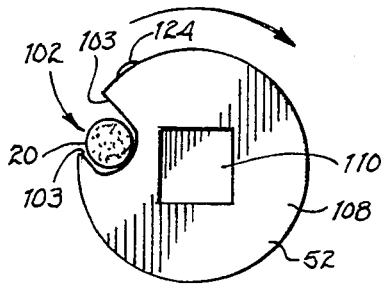
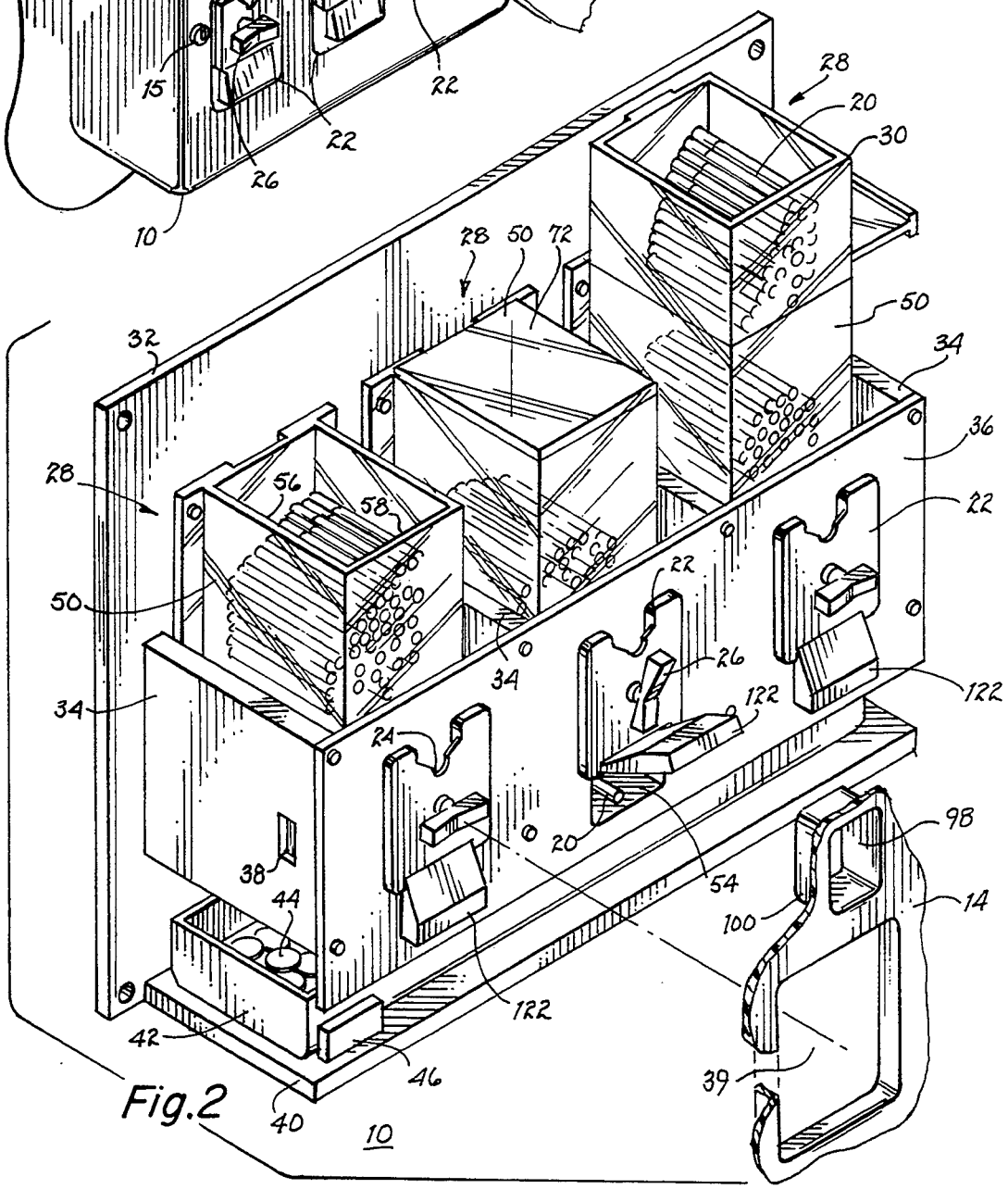
Fig.2

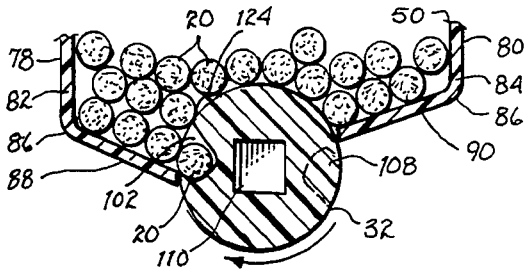
Fig. 7
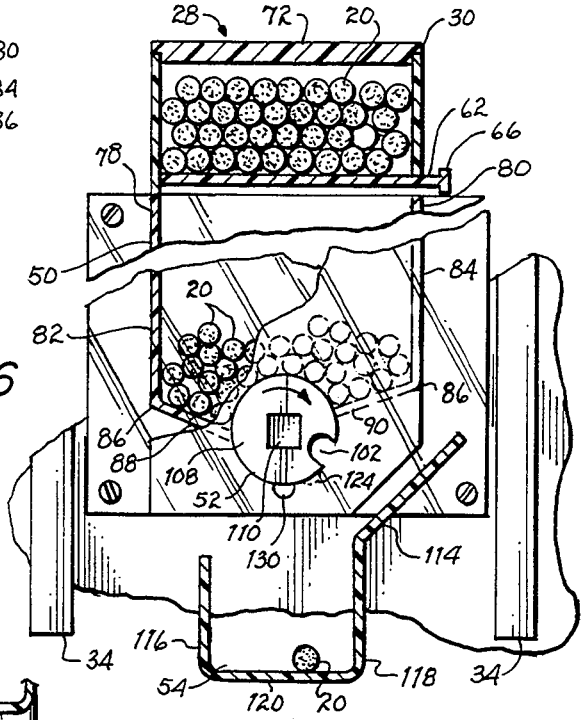
Fig. 6
Fig. 5
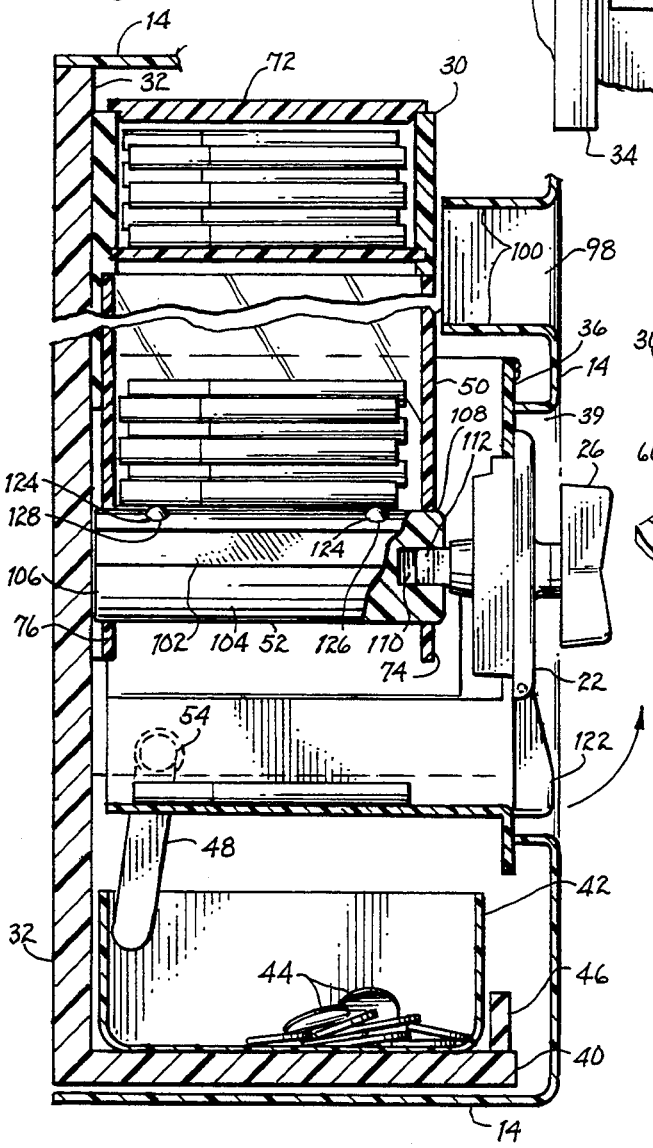
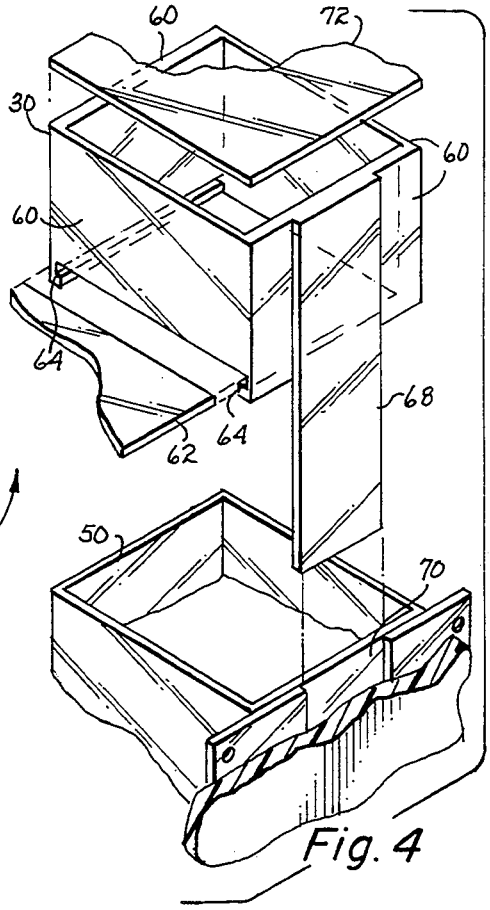
Fig. 4

VENDING MACHINE FOR INDIVIDUAL CIGARETTES

TECHNICAL FIELD OF THE INVENTION

The present invention relates generally to vending machines. More specifically, the present invention relates to coin-operated vending machines that dispense cigarettes one at a time.

BACKGROUND OF THE INVENTION

Vending machines intended for dispensing packs of cigarettes were once plentiful. However, many factors have combined to reduce their availability throughout society. Social pressures, based on health and other concerns, have been urging people not to smoke, and a smaller proportion of the population now has a need for cigarette vending machines. Moreover, cigarette pack costs have increased to a point where people are nervous about entrusting the required funds to a machine, which may break down and fail to deliver the requested product.

Furthermore, the conventional cigarette pack vending machines are complex, expensive, and massive devices. They tend to offer customers an exceedingly large selection of cigarette brands, and include complex and costly coin and bill changers to handle the large amounts of money needed for purchases. They tend to require a large amount of floor space, and this floor space is typically restricted to being near electrical outlets. In short, the demand for conventional cigarette pack vending machines often fails to justify the monetary, space, and other costs associated with these machines.

On the other hand, a vending machine for dispensing individual cigarettes need not suffer from the drawbacks associated with cigarette pack vending machines. For example, a customer need not entrust a large amount of money to a machine to purchase a single cigarette. In addition, many people have become part-time smokers. These part time smokers often wish to acquire only a single cigarette at a time. For those who are trying to quit smoking or to reduce their smoking, the ability to acquire only a single cigarette frees them from having to suffer the temptations of having a readily available stock of cigarettes from the remainder of a recently purchased pack. Moreover, an opportunity to acquire individual cigarettes from a vending machine frees people from having to obtain individual cigarettes through begging their friends and acquaintances.

However, the nature of cigarettes poses several obstacles to the successful operation of an individual-cigarette vending machine. For example, cigarettes are extremely lightweight and have a rather soft, spongy consistency when compared to items typically dispensed in vending machines. The lightweight and spongy nature of cigarettes gives them a tendency to become misaligned or jammed together so that they do not feed in a manner required by conventional vending machines. Moreover, sanitary requirements require the loading of cigarettes into a vending machine with little or no human handling.

SUMMARY OF THE INVENTION

Accordingly, it is an advantage of the present invention that an improved cigarette vending machine is provided.

Another advantage of the present invention is that a vending machine which dispenses one cigarette at a time is provided.

Another advantage of the present invention is that individual-cigarette vending machine is provided which is lightweight, small, and does not require electricity.

Yet another advantage is that the present invention provides an individual-cigarette vending machine which relies solely on gravity to reliably feed cigarettes into a dispensing mechanism.

Still another advantage is that the present invention provides an individual-cigarette vending machine which accommodates the loading and dispensing of cigarettes in a sanitary manner.

The above and other advantages of the present invention are carried out in one form by a gravity fed, individual-cigarette vending machine that includes a holding bin, a dispensing member, and a coin mechanism. The holding bin is dimensioned to retain a multiplicity of individual cigarettes in a substantially horizontal orientation. The dispensing member has an elongated shape and is oriented horizontally. This dispensing member is rotatably positioned underneath the holding bin, and it has an axially extending slot dimensioned to accommodate a single cigarette. The coin mechanism couples to the dispensing member. The coin mechanism is configured to permit rotation of the dispensing member upon the insertion of a coin in the dispensing member.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 1 shows a perspective view of an individual-cigarette vending machine constructed in accordance with the teaching of the present invention;

FIG. 2 shows a perspective view of internal components of the vending machine, as seen from underneath an outer casing;

FIG. 4 shows a perspective view of a loading box portion of the vending machine;

FIG. 5 shows a cross sectional side view of the vending machine;

FIG. 6 shows a cross sectional front view of a single vendor from the vending machine;

FIG. 7 shows a front side view depicting cooperation between a holding bin and a dispensing member;

FIG. 8 shows a front view of the dispensing member by itself; and

DETAILED DESCRIPTION OF THE PREFERRED EMBODIMENT

Figure 3:
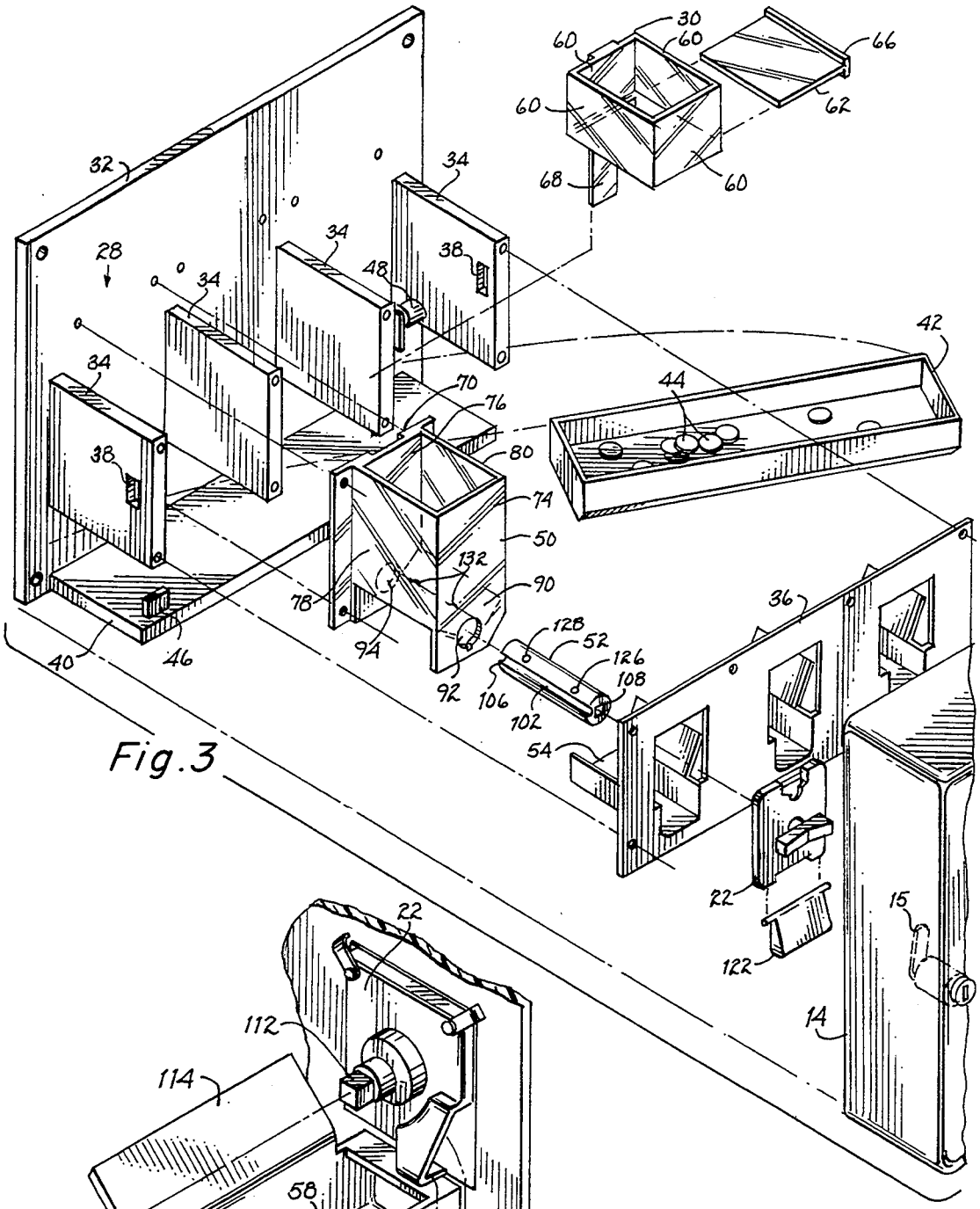
FIG. 3 shows an exploded view of the vending machine.

FIG. 1 shows a perspective view of an individual-cigarette vending machine 10 constructed in accordance with a preferred embodiment of the present invention. Vending machine 10 is a relatively small, lightweight machine, constructed primarily of plastic, and intended for installation on a building's wall 12 at approximately the three to five foot height above a floor (not shown). Valuable floor space need not be dedicated to vending machine 10.

Vending machine 10 includes an outer casing 14. Outer casing 14 is locked in place through key-operated locks 15. Outer casing 14 carries printed matter 16, which identifies brand names of cigarettes dispensed by vending machine 10. Printed matter 16 may further include warning labels and any other information considered desirable at a particular installation.

Viewing windows 18 permit observation of the quantity of cigarettes 20 remaining within vending machine 10. Persons in charge of stocking vending machine 10 may monitor windows 18 to determine when to refill vending machine 10, and potential customers may observe windows 18 to gain the comforting knowledge that vending machine 10 holds the product before they entrust their funds to vending machine 10.

Vending machine 10 further includes coin mechanisms 22, which extend through outer casing 14. The present invention contemplates the use of conventional coin mechanisms in connection with vending machine 10. Each coin mechanism 22 includes a coin slot 24 and a handle 26. Prior to insertion of a coin into a coin slot 24, coin mechanism 22 is in a locked condition, and handle 26 cannot be rotated. However, upon the insertion of a coin in a coin slot 24, a customer may then turn handle 26 in a single direction, which is clockwise in the preferred embodiment. This rotational motion causes vending machine 10 to dispense an individual cigarette 20, as is discussed below.

The preferred embodiment of the present invention is configured so that coin mechanism 22 accepts only quarters and does not make change. Lightweight and reliable examples of such mechanisms may be manufactured inexpensively. For example, the currently preferred embodiment of vending machine 10 uses a coin mechanism 22 sold under the Ultra Vend trade name by Innovative Design, Inc. of Idaho Falls, Id. However, the precise coinage accepted by coin mechanisms 22 and the provisions for making change are not important features of the present invention. Since numerous examples of acceptable coin mechanisms are known to those skilled in the art, coin mechanisms 22 are not discussed in detail herein.

FIG. 2 shows a perspective view of internal components of vending machine 10, as seen underneath outer casing 14. FIG. 3 shows an exploded view of vending machine 10. With reference to FIGS. 2 and 3, vending machine 10 includes three independent vendors 28. However, FIG. 3 shows only one of vendors 28 for clarity of illustration. In the preferred embodiment of vending machine 10, each vendor 28 is constructed in a manner similar to the others. As is discussed below, a loading box 30 may be used with any of vendors 28.

The use of three vendors 28 strikes an advantageous compromise between opposing concerns in the construction of vending machine 10. As the number of vendors 28 increases, the size, weight, and cost of vending machine 10 likewise increases. Thus, minimizing the quantity of vendors 28 is desirable. On the other hand, as the number of vendors 28 increases, the product selection offerable to customers increases as does the overall reliability of vending machine 10. By using three vendors 28, one vendor 28 may dispense menthol cigarettes, another vendor 28 may dispense filtered cigarettes, and yet another vendor 28 may dispense unfiltered cigarettes. Alternatively, different vendors 28 may simply dispense different sizes or brands of cigarettes 20. The need for offering additional product selection is believed to be of reduced importance to individual cigarette purchasers because they are typically less committed to smoking, when compared to cigarette pack purchasers. In addition, if one of vendors 28 malfunctions, customers may still obtain cigarettes 20 through two other vendors 28.

Vendors 28 are supported by a back plate 32, a plurality of side supports 34, and a front plate 36. Back plate 32 attaches to building wall 12 (see FIG. 1). Side supports 34 extend between back plate 32 and front plate 36 and securely attach to both back plate 32 and front plate 36. The preferred embodiment of vending machine 10 includes four of side supports 34 so that an individual compartment is formed for each of vendors 28 and so that adequate bracing is provided for front plate 36. The outside ones of side supports 34 include holes 38, which cooperate with locks 15 to securely attach outer casing 14. Coin mechanisms 22 securely attach to front plate 36. Each coin mechanism 22 is accessible from outside outer casing 14 through an opening 39 therein (see FIG. 2).

A shelf 40 extends outward from back plate 32 underneath side supports 34 and front plate 36. A coin box 42 sits on shelf 40 and extends under each of vendors 28 to catch coins 44 passed through coin mechanisms 22. Coin box 42 is retained in place through a stop 46, extending upward from the top surface of shelf 40, and a lock 48. Stop 46 and lock 48 entrap coin box 42 against back plate 32.

Each of vendors 28 includes a holding bin 50, a dispensing member 52 (see FIG. 3), a coin mechanism 22, and a dispensing tray 54. Holding bin 50 is configured to hold a multiplicity of cigarettes 20 in a substantially horizontal orientation. The axes of cigarettes 20 extend from back to front, relative to vending machine 10.

Preferably, cigarettes 20 are also oriented so that filters 56 of cigarettes 20 reside proximate back plate 32. By positioning cigarettes 20 with filters 56 near back plate 32, cigarettes 20 are dispensed with tobacco ends 58 thereof facing a customer. The customer then grasps a cigarette 20 by its tobacco end 58 rather than its filter 56. This handling promotes sanitation by minimizing the handling of filters 56, which are intended for placement in a smokers mouth. Printed matter (not shown) may be placed on vending machine 10 to remind stocking personnel of proper stocking procedures and cigarette orientations.

A horizontal cross section of holding bin 50 is configured so that the back-to-front length, relative to vending machine 10, is greater than an average length of a cigarette 20 to be dispensed by the respective vendor In the preferred embodiment, the side-to-side width accommodates around eleven average cigarette diameters. Thus, when vendor 28 dispenses standard sized cigarettes having an average length of around $3\frac{7}{8}$ inches and an average diameter of around 5/16 inch, the horizontal cross section of the preferred embodiment has an inside length of around $4\frac{1}{2}$ inches and an inside width of around $3\frac{1}{2}$ inches. Of course, those skilled in the art will appreciate that a wide variation in cigarette size can be tolerated by these dimensions and that these dimensions may be modified to accommodate cigarette sizes that substantially deviate from standard sizes.

Loading box 30 aids the loading of cigarettes 20 into holding bin 50. The lightweight nature of individual cigarettes 20, when considered with the sloped walls (discussed below) of holding bin 50, potentially cause cigarettes 20 to become misaligned within holding bin 50. For example, when loading cigarettes 20 without loading box 30, cigarettes 20 may have a tendency to become vertically oriented or to become oriented at a variety of random directions. Of course, they could be straightened. However straightening of cigarettes within holding bin 50 is undesirable because it encourages hand contact with cigarettes 20, which compromises sanitation, and it makes loading a time consuming activity.

FIG. 4 shows a perspective view which illustrates individual features of loading box 30. With reference to FIGS. 2–4, loading box 30 has substantially the same inside dimensions along a horizontal cross section as holding bin 50, and loading box 30 has substantially vertical walls 60. In addition, loading box 30 has a floor 62 which slidably couples to its walls 60 proximate lower edges thereof. Floor 62 may slidably couple to walls 60 through the use of mating slots 64 formed in opposing ones of walls 60. Slots 64 extend in a substantially horizontal direction from side-to-side, relative to vending machine 10. Floor 62 desirably includes a handle 66.

After sliding floor 62 so that it entirely blocks the bottom of loading box 30, cigarettes 20 may be easily placed in loading box 30. The horizontal floor 62 allows cigarettes 20 to remain in a proper horizontal orientation. Preferably, bottoms of cigarette packs may be opened so that an entire pack can be grasped, removed from its packaging, and then placed in loading box 30 in one move by manually handling only the tobacco end 58 of the cigarettes 20 for the entire pack. This process may be repeated for other packs until loading box 30 is full.

After placing loading box 30 on top of a holding bin 50 and placing a desired number of cigarettes in loading box 30, floor 62 may be slid out from under the cigarettes 20 within loading box 30. Since floor 62 slides from side to side, not back to front, cigarettes 20 tend to fall into holding bin 50 in a horizontal orientation. In other words, since floor 62 slides in a direction substantially perpendicular to the axes of cigarettes 20, neither end 56 or 58 of cigarettes 20 tends to drop prior to the other end and cigarettes 20 tend to fall while remaining in a horizontal orientation.

Loading box 30 includes a downward extending vertical post 68 which mates with a corresponding vertical slot 70 in holding bin 50. Post 68 and slot 70 reside adjacent to back plate 32. Post 68 and slot 70 are cooperatively positioned to align loading box 30 on top of holding bin 50. In other words, when post 68 has been inserted into slot 70, loading box 30 resides precisely on top of holding bin 50 so that no obstructions disturb the horizontal orientation of cigarettes 20 as they drop from loading box 30 into holding bin 50. Moreover, minor jostling of vending machine 10, including loading box 30 or holding bin 50, does not disturb this alignment.

Through the mating of post 68 and slot 70, loading box 30 removably couples to holding bin 50. Thus, after using loading box 30 to load one holding bin 50 with cigarettes 20, loading box 30 may be moved to another holding bin 50 to repeat the loading process. After loading all holding bins 50, loading box 30 may be left on top of one of holding bins 50 while outer casing 14 is placed back on vending machine 10. In fact, loading box 30, with floor 62 removed therefrom, may be filled with cigarettes 20 so that the quantity of cigarettes dispensable from the subject vendor 28 is increased. Lids 72 are configured to mate with the upper openings of loading box 30 and holding bins 50. Preferably, vending machine 10 includes at least three lids 72 so that each vendor 28 may be sealed to preserve cigarette freshness.

FIG. 5 shows a cross sectional side view of vending machine 10. FIG. 6 shows a cross sectional front view of a single vendor 28 from vending machine 10. With reference to FIGS. 2–3 and 5–6, each holding bin 50 includes rigid front and back vertical walls 74 and 76, respectively. Rigid left and right side walls 78 and 80, respectively, are divided into two sections each. Left and right top sections 82 and 84 of side walls 78 and 80, respectively, extend vertically. Top sections 82 and 84 terminate at an edge 86 which substantially parallels the direction of orientation for cigarettes 20 within holding bin 50. At edges 86, lower sections 88 and 90 of left and right side walls 78 and 80, respectively, extend downward and inward, with respect to holding bin 50.

Lower section walls 88 and 90 terminate adjacent to dispensing member 52. Preferably, lower walls 88 and 90 terminate with only a few thousandths of an inch clearance to dispensing member 52 to severely restrict air movement between walls 78 and 80 and dispensing member 52. The restricted air movement preserves cigarette freshness. 0f course, such a narrow clearance also prevents cigarettes. 20 from falling out of holding bin 50 between walls 88 or 90 and dispensing member 52. The precise positioning of dispensing member 52, which is preferably centered side-to-side underneath dispensing bin 50, is determined by openings 92 and 94 which reside in front and back vertical walls 74 and 76, respectively. Preferably, dispensing member 52 resides in a substantially horizontal orientation.

At least front wall 74 and preferably all of walls 74, 76, 78, and 80 are constructed from a smooth, rigid, transparent plastic material. The smooth finish on walls 74–80 promotes the even, vertically downward feeding of cigarettes 20 within holding bin 50 solely under the forces exerted by gravity. The transparent nature of front wall 74 permits observation of cigarettes 20 from outside outer casing 14. In particular, viewing windows 18 (see FIG. 1) are accommodated by the transparent nature of wall 74 and an opening 98 within outer casing 14. A wall 100 surrounds opening 98 and extends backward a short distance to block vision to other components within vending machine 10. From outside vending machine 10 a person can observe only cigarette level within vending machine 10 through viewing windows 18.

Dispensing member 52 has an elongated, generally cylindrical shape with a diameter of around 1½ inches and a length of around 5 inches in the preferred embodiment. A slot 102 formed in an outer surface 104 of dispensing member 52 extends axially for the entire length of member 52. In other words, slot 102 extends in a direction substantially parallel to the orientation of cigarettes 20 within holding bin 50.

Slot 102 is dimensioned to loosely hold a single one of cigarettes 20, with the entire diameter of the single cigarette 20 contained within slot 102. Thus, as a single cigarette enters slot 102, the single cigarette may be moved past right lower wall 90 of holding bin 50. The size of slot 102 is sufficiently small to prevent two cigarettes from being held therein or from jamming.

Figure 9:
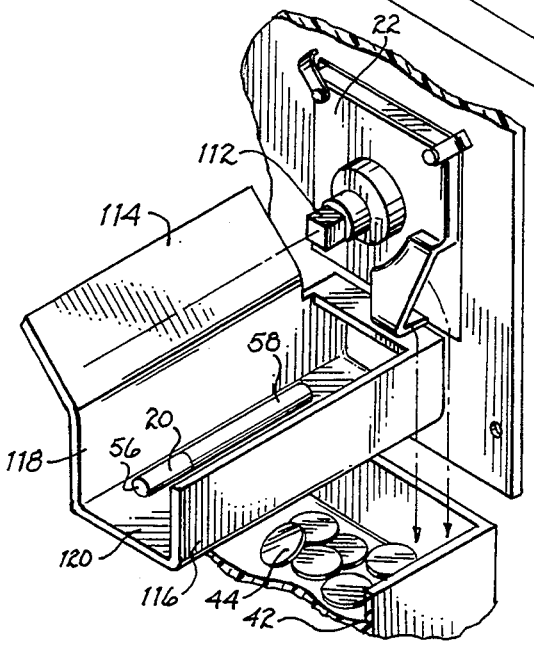
FIG. 9 shows a partial perspective view of a dispensing tray portion of the vending machine.

FIG. 7 shows a front view depicting the cooperation between holding bin 50 and dispensing member 52. FIG. 8 shows a front view of dispensing member 52 by itself. FIG. 9 shows a partial perspective view of dispensing tray 54 and a back side of coin mechanism 22. With particular reference to FIG. 8, slot 102 has opposing walls 103 (see FIG. 8) that are each offset from a radial direction for dispensing member 52. In particular, walls 103 are offset from a radial direction by an acute angle in the direction of rotation for dispensing member 52. With reference to FIGS. 5–9, this offset allows a cigarette 20 to enter slot 102 at the earliest possible moment when dispensing member 52 is rotated so that slot 102 is above lower left wall 88, and to prevent jamming potentially caused by having a cigarette 20 attempt to fall out of slot 102 as slot 102 rotates to a position near lower right wall 90.

With continued reference to FIGS. 5–9, a back end 106 of dispensing member 52 abuts back plate 32 to prevent backwards axial movement of dispensing member 52. A front end 108 of dispensing member 52 has a socket 110 formed therein. Socket 110 mates with a corresponding plug 112 of coin mechanism 22. Coin mechanism 22, through its plug 112, prevents forward axial movement of dispensing member 52. In spite of blocked axial movement, dispensing member 52 is free to rotate within openings 92 and 94 of front and back walls 74 and 76 of holding bin 50.

Of course, those skilled in the art will appreciate that such rotation is controlled by coin mechanism 22. Until a coin 44 is inserted into coin mechanism 22, neither coin mechanism 22 nor dispensing member 52 can rotate. Socket 110 and plug 112 are mutually configured so that prior to the insertion of a coin 44 in coin mechanism 22, slot 102 is locked at the position illustrated in FIG. 7. In other words, slot 102 has just risen above left lower wall 88 of holding bin 50. This is the loading position for dispensing member 52. Under normal operation, a cigarette 20 has fallen into slot 102 under the force of gravity in preparation for being dispensed.

After a coin 44 has been inserted into coin mechanism 22, coin mechanism 22 becomes unlocked, and a customer may turn handle 26 in a clockwise direction, as indicated by arrows in FIGS. 6–8. Upon turning handle 26, dispensing member 52 rotates. When dispensing member 52 reaches the position illustrated in FIG. 6 and illustrated in phantom in FIG. 7, the cigarette 20 is unloaded. At this unloading position, slot 102 resides just below right lower wall 90 of holding bin 50, and the force of gravity causes cigarette 20 to fall from slot 102.

As cigarette 20 falls from slot 102, it encounters an inclined wall 114 of dispensing tray 54. When viewed from the front of vending machine 10, dispensing tray 54 includes left and right upright walls 116 and 118 (see FIG. 6), respectively, extending upward from opposing edges of a generally horizontal floor 120. Inclined wall 114 resides at the upper end of right upright wall 118 and extends further upward and rightward until it nears right vertical wall 84 of holding bin 50.

The force of gravity causes cigarette 20 to roll down inclined wall 114 toward the interior of dispensing tray 54. When cigarette 20 encounters floor 120 of dispensing tray 54, left wall 116 blocks further movement to the left. Meanwhile, the customer continues to rotate handle 26. Eventually coin 44 exits coin mechanism 22 and falls outside dispensing tray 54, to the left of its left wall 116, as shown by an arrow in FIG. 9, into coin box 42. With continued rotation, coin mechanism 22 returns to its locked position, where slot 102 resides above lower left wall 88 of holding bin 50 and another cigarette 20 falls into slot 102. The customer may then open a hinged door 122, best viewed in FIG. 2, and remove cigarette 20 from dispensing tray 54 through opening 39 in outer casing 14. While cigarettes 20 have a generally cylindrical shape, their lightweight and spongy consistency pose problems for the smooth, reliable feeding of cigarettes 20 into slot 102 of dispensing member 52 between the confining walls of holding bin 50. In short, cigarettes 20 are prone to forming arches or bridges that might prevent their being fed under the force of gravity into slot 102.

Holding bin 50 and dispensing member 52 include several features which promote the reliable feeding of cigarettes 20 into slot 102 solely under the force of gravity and insure against the forming of arches or bridges within holding bin 50. For example, as shown in FIGS. 6–7, left and right lower side walls 88 and 90 of holding bin 50 are dimensioned to prevent bridging. In particular, the distances along walls 88 and 90 between dispensing member 52 and lower ends 86 are substantially different than an integral number of average cigarette diameters. In the preferred embodiment, this distance is between $3\frac{1}{8}$ and $3\frac{3}{4}$ cigarette diameters. With this distance being a non-integral number of cigarette diameters, the row of cigarettes 20 which resides immediately above the lowest row of cigarettes 20 within holding bin 50 tends not to ride precisely on top of the lowest row of cigarettes. Rather, they come to rest a significant distance above and to the side of the lower row of cigarettes. Consequently, the downward pressure exerted on the lowest row by all cigarettes above the lowest row has a substantial sideways component to it, and this sideways component urges cigarettes 20 toward slot 102.

In addition, lower left wall 88 extends further downward than lower right wall 90. This difference in vertical positioning causes any arches or bridges that might possibly form to have unequal footings. With unequal footing support on opposing sides, bridges are less likely to form.

Furthermore, dispensing member 52 includes an agitator 124 which causes cigarettes 20 within holding bin 50 to rise and fall through a caming action as dispensing member 52 rotates. In the preferred embodiment, agitator 124 includes front and back bumps 126 and 128, respectively. Bumps 126 and 128 increase the radius of dispensing member 52 where they are located. Preferably, bumps 126 and 128 reside in a line generally parallel to the orientation of cigarettes 20 within holding bin 50 and generally parallel to slot 102. Bumps 126 and 128 are symmetrically placed front-to-back so that an entire cigarette 20 is lifted by bumps 126–128 as dispensing member 52 rotates, rather than simply one end of a cigarette. Bumps 126 and 128 reside ahead of slot 102, relative to the direction of rotation for dispensing member 52, a distance less than the diameter of an average cigarette 20. Thus, cigarettes 20 which are picked up and dropped by bumps 126 and 128, fall immediately in front of slot 102. Not only does the picking up and dropping action disturb any arches or bridges which may be trying to form, but when cigarettes 20 fall immediately in front of slot 102, they have some momentum which propels them into slot 102 when slot 102 does not already contain a cigarette 20.

In the preferred embodiment, bumps 126–128 have a height approximately equivalent to $\frac{1}{2}$ of an average cigarette diameter. A notch 130 (see FIG. 6) in front opening 92 of holding bin 50 accommodates bumps 126–128 during assembly of vending machine 10. Moreover, notches 132 in lower left and lower right walls 88 and 90 accommodate bumps 126 and 128 during rotation of dispensing member 52. In other words, notches 132 (see FIG. 3) permit bumps 126 and 128 to pass through walls 88 and 90 as dispensing member 52 rotates.

Preferably, each of bumps 126 and 128 extends axially along dispensing member 52 for only a short distance. This distance is preferably significantly shorter than an average cigarette length. Since air can enter holding bin 50 through notches 132, smaller bumps 126–128 permit notches 132 to be smaller. With smaller notches 132, less air enters holding bin 50 and cigarette freshness is promoted.

The amount of physical contact between dispensing member 52 and cigarettes 102 within holding bin 50 is maximized. By maximizing the amount of contact between dispensing member 52 and cigarettes 20 in holding bin 50, a maximum amount of agitation of cigarettes 20 occurs as dispensing member 52 rotates, and this agitation works against the formation of arches or bridges.

In particular, a maximum arc of dispensing member 52 resides within holding bin 50. In the preferred embodiment, approximately 180° of arc for dispensing member 52, minus the arc distance of the opening to slot 102, resides within holding bin 50. If lower left wall 88 of holding bin 50 met dispensing member 52 any lower, then cigarettes 20 might tend to roll out below wall 88 and cause a jam. If lower left wall 88 met dispensing member 52 any higher, then less contact would take place between dispensing member 52 and cigarettes 20 in holding bin 50. If lower right wall 90 met dispensing member 52 any significant distance lower, then cigarettes 20 would tend to unload prior to slot 102 falling below wall 90 and cause a jam. If lower right wall 90 met dispensing member 52 any higher, then less contact would take place between dispensing member 52 and cigarettes 20 in holding bin 50.

In summary, the present invention provides an improved cigarette vending machine. The cigarette vending machine provided by the present invention dispenses one cigarette at a time. The present vending machine is lightweight, small, and does not require electricity. Rather, the present vending machine relies solely upon the force of gravity to reliably feed cigarettes into a dispensing mechanism. Moreover, the present invention provides an individual-cigarette vending machine which accommodates the loading and dispensing of cigarettes in a sanitary manner.

The present invention has been described above with reference to a preferred embodiment. However, those skilled in the art will recognize that changes and modifications may be made in this preferred embodiment without departing from the scope of the present invention. For example, those skilled in the art may vary the precise number of vendors included in the vending machine. In addition, those skilled in the art may vary dimensions of various vendors to accommodate exceedingly slim, short or long cigarettes. Furthermore, those skilled in the art may adapt the teaching of the present invention to work in connection with coin mechanisms other than the one described herein. Still further, those skilled in the art may devise boxes of bulk cigarettes which are dimensioned to fit within the holding bins. Loading would be eased by placing such bulk containers into the holding bins. These and other changes and modifications which are obvious to those skilled in the art are intended to be included within the scope of the present invention.

What is claimed is:

1. A gravity fed, individual-cigarette vending machine comprising:

a holding bin dimensioned to retain a multiplicity of individual cigarettes in a substantially horizontal orientation;

a substantially horizontally oriented, elongated dispensing member rotatably positioned underneath said holding bin, said dispensing member having an axially extending slot dimensioned to accommodate a single cigarette;

a coin mechanism coupled to said dispensing member, said coin mechanism being configured to permit rotation of said dispensing member upon the insertion of a coin in said coin mechanism, said dispensing member being centrally located underneath said holding bin, said bin having a first wall extending from a first wall upper edge that substantially parallels said slot of said dispensing member downward and inward toward said dispensing member; and a second wall extending from a second wall upper edge that substantially parallels said slot of said dispensing member downward and inward toward said dispensing member, said first and second walls residing on opposing sides of said dispensing member, said dispensing member rotating in a single direction so that said slot rises proximate said first wall and falls proximate said second wall; and said first wall extending lower than said second wall.

2. An individual-cigarette vending machine as claimed in claim 1 wherein said holding bin includes at least one transparent wall to permit observation from outside said bin of the quantity of cigarettes held therein.

3. An individual-cigarette vending machine as claimed in claim 2 additionally comprising an outer casing configured to enclose said holding bin and said dispensing member, said outer casing having a first opening therein through which said coin mechanism extends, and said outer casing having a second opening positioned in the vicinity of said transparent wall of said holding bin, said second opening permitting observation from outside said outer casing of the quantity of cigarettes held within said holding bin.

4. An individual-cigarette vending machine as claimed in claim 3 additionally comprising a dispensing tray located beneath said dispensing member and being accessible from outside said outer casing through said outer casing.

5. An individual-cigarette vending machine as claimed in claim 4 wherein said dispensing tray includes an inclined wall extending upward and away from said dispensing member, said inclined wall being for receiving individual cigarettes from said dispensing member.

6. An individual-cigarette vending machine as claimed in claim 1 wherein:

said first wall extending a distance between said first wall upper edge and said dispensing member which distance is substantially different than an integral number of average diameters for said cigarettes.

7. An individual-cigarette vending machine as claimed in claim 1 wherein:

said dispensing member slot having an opening which extends in an arc along a direction of rotation for said dispensing member for a predetermined distance; and said dispensing member being positioned relative to said first and second walls so that at least 180° of said dispensing member, relative to said direction of rotation for said dispensing member, minus approximately said predetermined arc distance, resides within said holding bin.

8. An individual-cigarette vending machine as claimed in claim 1 wherein:

said coin mechanism permits rotation of said dispensing member in a predetermined direction; and said dispensing member slot has first and second wails extending from an exterior surface of said dispensing member into an interior of said dispensing member, said first and second walls being offset an acute angle from a radial direction, said offset occurring along said predetermined direction of rotation.

9. An individual-cigarette vending machine as claimed in claim 1 wherein said dispensing member comprises means for agitating at least some of said cigarettes retained in said holding bin.

10. An individual-cigarette vending machine as claimed in claim 9 wherein:

said coin mechanism permits rotation of said dispensing member in a predetermined direction; and said agitating means is positioned ahead, relative to said predetermined direction, of said slot on said dispensing member by a distance which is less than an average diameter for said cigarettes.

11. An individual-cigarette vending machine as claimed in claim 9 wherein:

said dispensing member has a generally cylindrical shape; and said agitating means comprises a bump located on a surface of said dispensing member so that the radius of said dispensing member in the vicinity of said bump is greater than at other vicinities of said dispensing member.

12. An individual-cigarette vending machine as claimed in claim 9 wherein said agitating means extends axially along said dispensing member for a distance which is less than an average length for said cigarettes.

13. An individual-cigarette vending machine s claimed in claim 1 wherin:

a horizontal cross-section of said holding bin has inside dimensions; and said vending machine additionally comprises a loading box positioned above said holding bin, said loading box having horizontal cross-section inside dimensions substantially the same as said holding bin, and said loading box having a floor slidably coupled thereto.

14. An individual-cigarette vending machine as claimed in claim 13 wherein said loading box is configured so that said floor slides in a direction perpendicular to said slot in said dispensing member.

15. An individual-cigarette vending machine as claimed in claim 13 wherein said loading box is removably attachable to said holding bin, and said vending machine additionally comprises means, attached to one of said loading box and said holding bin, for aligning said loading box to said holding bin.

16. An individual-cigarette vending machine as claimed in claim 1 additionally comprising:

a second holding bin dimensioned to retain a second multiplicity of individual cigarettes in a substantially horizontal orientation;

a second horizontally oriented, elongated dispensing member rotatably positioned underneath said second holding bin, said second dispensing member having an axially extending slot dimensioned to accommodate a single one of said second multiplicity of individual cigarettes; and a second coin mechanism coupled to said member, said second coin mechanism being configured to permit rotation of said second dispensing member upon the insertion of a coin therein.

17. An individual-cigarette vending machine as claimed in claim 16 additionally comprising:

a third holding bin dimensioned to retain a third multiplicity of individual cigarettes in a substantially horizontal orientation;

a third horizontally oriented, elongated dispensing member rotatably positioned underneath said third holding bin, said third dispensing member having an axially extending slot dimensioned to accommodate a single one of said third multiplicity of individual cigarettes; and a third coin mechanism coupled to said member, said third coin mechanism being configured to permit rotation of said third dispensing member upon the insertion of a coin therein.

18. A gravity fed, individual-cigarette vending machine comprising:

a holding bin dimensioned to retain a multiplicity of individual cigarettes in a substantially horizontal orientation.

a substantially horizontally oriented, elongated dispensing member rotatably positioned underneath said bin, said dispensing member having an axially extending slot dimensioned to accommodate a single cigarette;

a coin mechanism coupled to said dispensing member, said coin mechanism being configured to permit rotation of said dispensing member upon the insertion of a coin in said coin mechanism, said dispensing member including means for agitating at least some of said cigarettes retained in said holding bin, said agitating means extending axially along said dispensing member for a distance which is less than an average length for said cigarettes, said bin comprising a wall which extends downward and inward toward said dispensing member; and said wall including a notch therein to accommodate movement of said agitating means through said wall.

19. A gravity fed, individual-cigarette vending machine comprising:

a coin mechanism configured to permit a rotating motion upon the intersection of a coin therein;

a substantially horizontally oriented, dispensing member having a generally cylindrical shape and being coupled to said coin mechanism and configured to be rotated in a predetermined direction upon the insertion of said coin in said coin mechanism, said dispensing member having:

an axially extending slot formed in an outer surface thereof, and agitating means formed on said outer surface thereof;

a holding bin positioned above said dispensing member and being dimensioned to retain a multiplicity of individual cigarettes in a substantially horizontal orientation in which said cigarettes reside substantially parallel to said dispensing member slot, said holding bin including:

a first wall extending from a first wall upper edge that substantially parallels said slot of said dispensing member downward and inward toward said dispensing member, and a second wall extending from a second wall upper edge that substantially parallels said slot of said dispensing member downward and inward toward said dispensing member, said first and second walls residing on opposing sides of said dispensing member, said dispensing member rotating so that said slot rises proximate said first wall and falls proximate said second wall; and said first wall extending lower than said second wall.

20. An individual-cigarette vending machine as claimed in claim 19 wherein said first wall extends a distance between said first wall upper edge and said dispensing member which distance is substantially different than an integral number of cigarette diameters.

21. An individual-cigarette vending machine as claimed in claim 19 wherein said holding bin includes at least one transparent wall to permit observation from outside said bin of the quantity of cigarettes held therein.

22. An individual-cigarette vending machine as claimed in claim 19 wherein said dispensing member slot has first and second walls extending from an exterior surface of said dispensing member into an interior of said dispensing member, said first and second walls being offset an acute angle from a radial direction of said dispensing member, said offset occurring along said predetermined direction of rotation.

23. An individual-cigarette vending machine as claimed in claim 19 wherein:

said agitating means of said dispensing member comprises a bump located on said outer surface of said dispensing member so that the radius of said dispensing member in the vicinity of said bump is greater than at other vicinities of said dispensing member; and said bump is positioned ahead, relative to said predetermined direction of rotation, of said slot on said dispensing member by a distance which is less than an average cigarette diameter.

24. An individual-cigarette vending machine as claimed in claim 23 wherein:

said bump extends axially along said dispensing member for a distance which is less than an average length for said cigarettes; and said first and second walls each include a notch therein to accommodate movement of said bump past said walls.

25. A gravity fed, individual-cigarette vending machine comprising:

a coin mechanism configured to permit a rotating motion upon the insertion of a coin therein;

a substantially horizontally oriented, dispensing member having a generally cylindrical shape and being coupled to said coin mechanism and configured to be rotated in a predetermined direction upon the insertion of said coin in said coin mechanism, said dispensing member having:

an axially extending slot formed in an outer surface thereof, and agitating means formed on said outer surface thereof;

a holding bin positioned above said dispensing member and being dimensioned to retain a multiplicity of individual cigarettes in a substantially horizontal orientation in which said cigarettes reside substantially parallel to said dispensing member slot, a horizontal cross-section of said holding bin having inside dimensions, and said holding bin including:

a first wall extending from a first wall upper edge that substantially parallels said slot of said dispensing member downward and inward toward said dispensing member, and a second wall extending from a second wall upper edge that substantially parallels said slot of said dispensing member downward and inward toward said dispensing member, said first and second walls residing on opposing sides of said dispensing member;

a loading box positioned above said holding bin, said loading box having horizontal cross-section inside dimensions substantially the same as said holding bin, and said loading box having a floor slidably coupled thereto, said dispensing member rotating so that said slot rises proximate said first wall and falls proximate said second wall; and said first wall extending lower than said second wall.

26. An individual-cigarette vending machine as claimed in claim 25 wherein said loading box is configured so that said floor slides in a direction perpendicular to said slot in said dispensing member.

27. An individual-cigarette vending machine as claimed in claim 25 wherein:

said agitating means of said dispensing member comprises a bump located on said outer surface of said dispensing member so that the radius of said dispensing member in the vicinity of said bump is greater than at other vicinities of said dispensing member;

said bump is positioned ahead, relative to said predetermined direction of rotation, of said slot on said dispensing member by a distance which is less than an average cigarette diameter;

said bump extends axially along said dispensing member for a distance which is less than an average length for said cigarettes; and said first and second walls each include a notch therein to accommodate movement of said bump past said walls.

* * * * *